United States Patent [19]

Kirsch

[11] 4,020,338

[45] Apr. 26, 1977

[54] AUTO HEADLIGHT LENS SHIELD

[75] Inventor: Norton M. Kirsch, Chicago, Ill.

[73] Assignee: Auto Gard, Inc., Chicago, Ill.

[22] Filed: June 16, 1975

[21] Appl. No.: 586,869

[52] U.S. Cl. ..... 240/46.53; 240/7.1 R; 240/46.55; 240/46.01

[51] Int. Cl.[2] ..... F21V 11/16

[58] Field of Search ..... 240/46.45, 46.47, 46.49, 240/46.51, 46.53, 46.55, 46.57, 46.59, 7.1 R, 46.01; 40/131 R, 131 A, 129 C

[56] References Cited

UNITED STATES PATENTS

| | | | |
|---|---|---|---|
| 1,070,199 | 8/1913 | Stifil | 240/46.01 |
| 1,167,078 | 1/1916 | Jones | 240/46.01 X |
| 1,820,788 | 8/1931 | Failing | 40/129 C X |
| 1,871,648 | 8/1932 | Baker | 40/131 A |
| 1,923,970 | 8/1933 | Dowling | 240/46.51 X |
| 2,326,354 | 8/1943 | Hale | 240/46.01 X |
| 2,350,676 | 6/1944 | Fetterman | 240/46.53 |
| 2,867,718 | 1/1959 | Anderson | 240/46.45 X |
| 2,999,924 | 9/1961 | Mottier et al. | 240/46.45 X |

FOREIGN PATENTS OR APPLICATIONS

| | | | |
|---|---|---|---|
| 1,378,162 | 12/1974 | United Kingdom | 240/46.01 |

*Primary Examiner*—John Gonzales
*Attorney, Agent, or Firm*—Laff, Whitesel & Rockman

[57] ABSTRACT

A headlight lens shield comprises a convex base plate with a rectangular opening therein. The convex base plate includes three dimples which accurately locate the shield on the face lens of a sealed beam headlight.

4 Claims, 6 Drawing Figures

AUTO HEADLIGHT LENS SHIELD

This invention relates to automobile headlights and more particularly to lens shields for guiding and directing the light in a forward direction and for improving and changing the appearance of an automobile headlight.

Automobile headlights generally use a so-called sealed beam unit which comprises a general purpose lens and a reflector sealed together. The oncoming appearance is one of a bright disc of light, often directed into the oncoming motorist's eyes. From the driver's viewpoint, these headlights light the road, the shoulders, and often the trees, wires, etc. over the road. Thus, it is possible that there may be potential problems under some driving conditions when a general purpose lens is used and when too much light is directed in the wrong direction and not enough in a desired direction.

It would be helpful if the driver has an option whereby the headlight may be guided and directed in a desired direction to insure maximum visibility and to shield unwanted light. In the process, it is desirable for the overall appearance of existing circular automobile headlights to be improved and made more modern. Among other things, a modern appearance would provide a rectangular light source, of approximately the size and shape used on the newer automobiles.

Accordingly, an object of the invention is to provide new and improved automobile headlight adapters. Here, an object is to provide shields having rectangular openings which may be added to existing headlights, quickly and easily. In this connection, an object is to provide a lightweight lens shield which may be attached over existing sealed beam lenses without requiring any structural modification thereto.

Still another object is to provide stylish headlight adapters which modify the appearance of existing headlights. Here an object is to convert disc-shaped headlights into rectangularly shaped lights.

In keeping with an aspect of the invention, these and other objects are accomplished by providing an integral, lightweight, headlight shield comprising a generally convex plate having a rectangular opening to provide for a lens clearance at the front of the sealed beam lamp. The shields are of a size and dimension which fit over the lens of conventional sealed beam lights. Position locators on the convex shield fit over detents on the headlight lens. A rectangular opening in the shield emits light in a selected direction and reflects all remaining light back into the sealed beam unit.

The nature of two preferred embodiments of the invention is set forth in the attached drawings, wherein.

The invention comprises a convex lens shield member 21 integrally formed so that it may be attached, as an applique, over a sealed beam headlight lens. The surface of the convex shield includes three dimples 22–24 and peripheral offset step 25.

Figure 2:
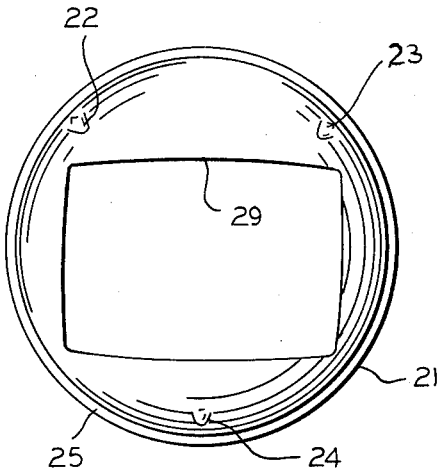
FIG. 2 is a front elevation view of the lens shield of FIG. 1.
Figure 1:
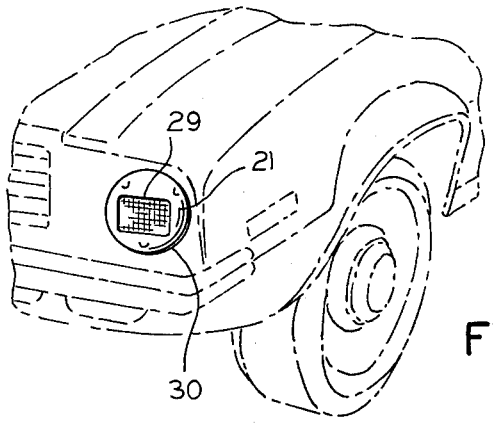
FIG. 1 is a perspective view of an automobile fender and headlight with the lens shield incorporating the invention.
Figure 3:
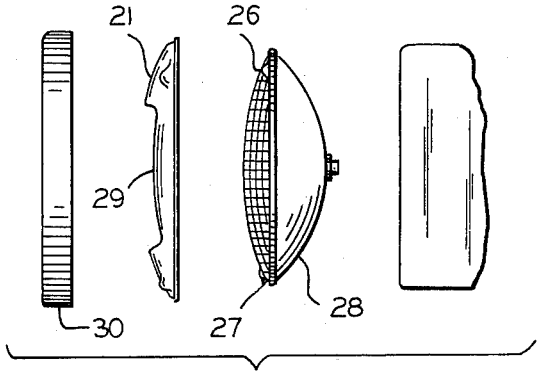
FIG. 3 is an exploded side view of the rim or door, lens shield, headlight and fender.
Figure 4:
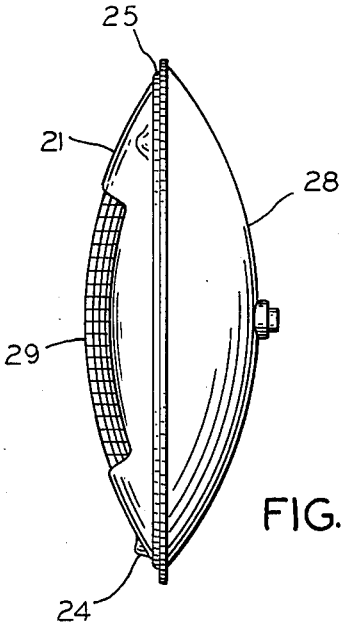
FIG. 4 is a side elevation view of a headlight with the inventive shield in place on it.
Figure 5:
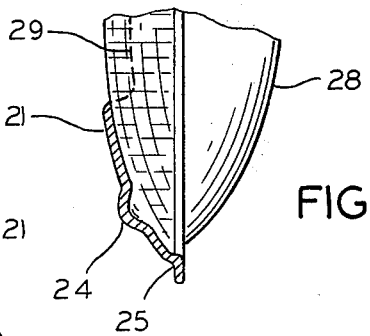
FIG. 5 is a fragmentary cross-sectional view of the bottom of the headlight and shield of the structure of FIG. 4.

The lens shield 21 is molded or embossed with an internal contour which is complementary to the external contour of a sealed beam headlight lens. The three dimples 22–24 are formed at locations corresponding to three detents (two of which are seen at 26, 27, FIG. 3) regularly provided on the headlight lens of a sealed beam unit 28. Therefore, the inventive lens shield 21 may be accurately positioned over the lens of the sealed beam unit. When the dimples 22–24 are fitted over the detents on the sealed beam unit, the inventive lens shield is aligned as perfectly as the sealed beam headlight is aligned.

Formed in and integral with the lens shield 21 is a generally rectangular opening 29, having four sides which expose the clear lens in front of the sealed beam unit. The back of the lens shield is preferably made reflective so that all light falling on it is directed back into the sealed beam unit itself. This means that all light originating within the sealed beam unit is directed out the rectangular opening 29, thereby increasing the density of the light flux in the rectangular opening as compared to the density of the light flux in an unshielded sealed beam unit.

It should now be apparent that the shield tends to function somewhat as an iris. By making the rectangular opening smaller or larger, the light may be made more or less concentrated. Also, those familiar with sealed beam lens construction know that different areas of the sealed lens units include prisms or flutes which direct or scatter the light in different directions. Therefore, different lighting effects are produced according to the location of opening 29 with respect to the sealed beam lens. If the opening 29 is of suitable size and properly centered over the headlight, the emitted beam may continue to light almost the same area which an unshielded lens lights. On the other hand, if the opening 29 is moved up or down, left or right, it is possible to shift the location of the beam somewhat. Therefore, it is possible to selectively emphasize the light in certain areas. One shield, with an opening 29 displaced in one direction, may tend to better light the shoulders of the road. Another shield, with opening 29 displaced in another direction, may tend to better light the center of the road. Likewise, the beam may also tend to be raised or lowered by the displacement of the opening 29.

It should now be apparent that a lens shield having a particularly placed opening may be selected to produce a particularly desired lighting effect. Thus, a driver may select that shield which contains an opening that best serves his particular lighting need. The embodiment preferred for all around general usage is the largest possible rectangular opening, centered on the circular lens disc since this will tend to preserve the general lighting characteristics built into the sealed beam unit. Therefore, with this general purpose lens shield, the optical light control comes primarily from the lens formed in the sealed beam unit, with little or no appreciable optical effect from the lens shield, per se.

The periphery 25 of the shield includes an offset step portion which is shaped and dimensioned to fit behind and to be snugly held by the rim or door 30 of an automobile headlight. Therefore, to install the shield, the rim or door 30 is removed from the automobile headlight. Then, the shield is placed against the lens of the sealed beam unit, with the dimples 22–24 over the detents 26, 27 on the lens of the unit. Next, the rim or door is replaced around the lens. The inner periphery of the rim or door fits against the peripheral offset step 25 and holds the shield firmly in place.

Figure 6:
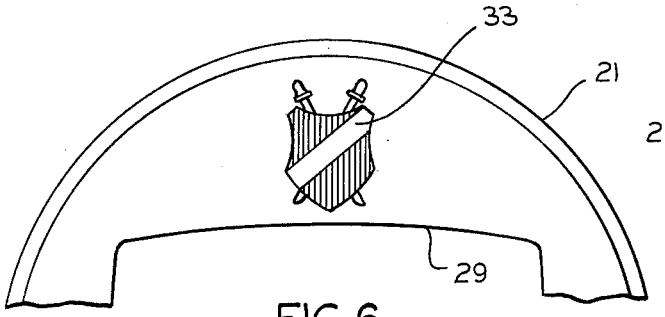
FIG. 6 is a front elevation view of the shield with a decorative insigna.

While the inner lens shield surface may be highly reflective to return light into the headlight unit, the outer surface is selected for its appearances. More particularly, the outside surface of some shields may be plated to reflect and shine, while other shields may be painted black for contrast. Still other shields may have outside surfaces to match or contrast with the color of an associated automobile body. As shown in FIG. 6, the shield may also be personalized by a crest 33, initial, or the like. Of course, other personal preferences may be served, as by an ornamentation of flowers, plaids, or the like.

Those who are skilled in the art will readily perceive how modifications may be made in the inventive lens shield. Therefore, the appended claims are to be construed to cover all equivalent structures falling within the scope and spirit of the invention.

I claim:

1. A headlight lens shield comprising a convex base plate having a reflective inner surface shaped and dimensioned to fit over the front lens of a circular sealed beam headlight, the outer periphery of the shield being an offset rim step fitting behind and held in place by the rim or door surrounding said headlight, and a rectangular front opening in said shield for passing light transmitted through the headlight lens, the diagonal of said rectangular opening approaching the diameter of said headlight and the area of said rectangular opening being a substantial portion of the area of the circular lens of said sealed beam headlight.

2. The lens shield of claim 1 wherein the outside surface of said shield has an ornamental finish.

3. A headlight lens shield comprising a convex base plate having a reflective inner surface shaped and dimensioned to fit over the front lens of sealed beam headlight, said convex base plate having position locators shaped and dimensioned to fit over detents on the headlight lens, the outer periphery of the shield being an offset rim step fitting behind and held in place by the rim or door surrounding said headlight, and a rectangular front opening in said shield for passing light transmitted through the headlight lens.

4. The lens shield of claim 3 wherein said rectangular front opening is located in said shield at a position which guides and directs the light from the sealed beam unit in a preselected direction.

* * * * *